US005821450A

United States Patent [19]

Fedida

[11] Patent Number: 5,821,450

[45] Date of Patent: Oct. 13, 1998

[54] INCAPACITATING COMPOSITION AND A DEVICE FOR ITS USE

[75] Inventor: José Fedida, Mouans-Sartoux, France

[73] Assignee: Societe Mediterranneenne D'Aerosols, Plan-De-Grasse, France

[21] Appl. No.: 809,371

[22] Filed: Mar. 31, 1997

[30] Foreign Application Priority Data

Aug. 10, 1995 [FR] France ..... 95 09856

[51] Int. Cl.[6] ..... F42B 12/46

[52] U.S. Cl. ..... 102/370; 102/502; 102/512

[58] Field of Search ..... 102/370, 502, 102/512

[56] References Cited

U.S. PATENT DOCUMENTS

| | | | |
|---|---|---|---|
| 1,695,228 | 12/1928 | Bradner et al. | 102/370 X |
| 1,750,101 | 3/1930 | Goss | 514/504 X |
| 5,217,708 | 6/1993 | Pinkney | 424/45 |
| 5,260,313 | 11/1993 | Frome | 514/552 |
| 5,397,385 | 3/1995 | Watts | 424/78.09 |
| 5,429,301 | 7/1995 | Franks | 239/1 |

*Primary Examiner*—Peter A. Nelson
*Attorney, Agent, or Firm*—Fisher, Christen & Sabol

[57] ABSTRACT

An incapacitating composition, for example of the type containing at least one incapacitating active ingredient is described, characterised in that it contains, as the active ingredient, a synergistic mixture of a piperidide, such as the piperine extracted from certain peppers, and of capsaicinoids extracted from certain capsicums. The composition is in the form of a solution, or combined with a powder, optionally diluted in an immiscible diluent The composition spraying device comprises an aerosol or a spray lance for the solution or the powder, or pyrotechnic or smoke-producing systems, weapons using ammunition comprising capsules of the powder or liquid containing the incapacitating composition, which ammunition is intended to be fired and to explode on the target or in the space surrounding the target.

24 Claims, No Drawings

INCAPACITATING COMPOSITION AND A DEVICE FOR ITS USE

The present invention concerns an incapacitating composition, particularly for use in aerosol form, for the defense of the person and property, and a device for using such a composition.

The prior art includes incapacitating compositions which are used in aerosols. Certain of such compositions contain ortho-chlorobenzalmalononitrile, or ortho-chlorobenzylidene, CBM or CS, which is the most frequently used substance, and which neutralizes a subject by dint of its irritant and incapacitating properties, causing the eyes to water and causing coughing.

However, such compositions have very little effect on an aggressive person under the influence of alcohol or drugs, or on dogs. Further, the irritants used are synthetic substances which are not readily biodegradable, so the effect persists since they impregnate and remain in the clothing of the target person or the localities in which they are used. This causes problems to police forces when a person is interviewed after such a gas has been used, since the police themselves may be inconvenienced by the residual substance.

Aerosols are also known which use low doses of capsaicin as the active ingredient, in the form of capsicum oleoresin, extracted from cayenne pepper. This product overcomes some of the disadvantages of the synthetic substances mentioned above. It is based on a product of natural origin, which is non toxic and ecological.

Capsicum oleoresin has a relatively low capsaicin content, however, which limits the effectiveness of existing products and increases the cost if a product with acceptable effectiveness is required.

Further, apparatus for using known compositions is limited to aerosols with a range of a few meters, and thus can only be suitable in a limited number of situations.

One aim of the present invention is to provide an incapacitating composition which can overcome the disadvantages of existing compositions, and to provide one or more devices for packaging and for effective use of the composition in a wide range of defense or combat situations.

More particularly, the aim of the invention is to provide a composition which has an extremely effective incapacitating effect using only natural constituents which are completely biodegradable.

The invention also aims to provide a composition with a very wide spectrum of action, and in particular which remains effective on persons who are under the influence of alcohol or various drugs, or on animals.

The invention further aims to provide a composition which is free of secondary effects on persons exposed thereto, and which has negligible persistence in clothing or in the environment.

The invention further aims to provide a composition which is economical to produce and easy to use.

The object of the invention is thus to provide an incapacitating composition containing at least one active ingredient with an incapacitating effect, characterized in that it contains, as the active ingredient, a synergetic mixture of a piperidide and capsaicinoids.

Other characteristics of the composition of the invention are:

the capsaicinoids are constituted by capsaicin obtained from an extract of a capsicum from the solanaceae family, selected from the group formed by *Capsicum Frutescens L.* and *Capsicum annuum L;* the pepper extract has a guaranteed capsaicin content of no less than 8%, in particular in the range 8% to 10%;

the piperidides contain piperine and are obtained from an essential pepper oil;

the essential pepper oil is obtained from a pepper from the piperaceae family, in particular a pepper from the group formed by: black or common pepper, the fruit of *Piper Nigrum L.*; long pepper: *Piper longum L.* and *Piper Officinarum; Betel-Piper Betle L.; Piper methysticum; Piper Parthenium; Piper angustifolium*; and *Xylopia aethiopica;* the impregnating solution advantageously contains a coupling solvent, which can produce a homogeneous mixture of constituents at room temperature, and is constituted by a substance which has no odor or only a slight odor of food contact grade, constituted by a hydrophilic pole and a lipophilic pole in the same molecule. The coupling solvent is constituted by a glycol ether, for example.

The composition of the invention can be presented in a number of forms, in particular in the form of a solution of active ingredients and, if necessary, a coupling solvent, the solution then being suitable for projection towards a target by means of a suitable packaging and/or projection device. In a variation, the composition is presented in the form of a powder impregnated with the active ingredients and suitable for projection towards a target. In a further variation of its presentation, the composition is associated with a powder, and the combination is dispersed in a non-miscible liquid such that projection of the powder and composition is accomplished by projecting the dispersing liquid.

The invention also concerns a device containing an incapacitating composition with the above characteristics. The characteristics of the device depend on the presentation of the composition to be projected.

The invention will be better understood from the following non-limiting description which successively details the composition of the invention and then a few devices which are suitable for packaging and projecting the composition. Source and methods for the preparation of the active ingredients of an incapacitating composition:

The source of the active ingredients of the composition is as follows. The essential pepper oil is obtained by hydrodistillation of dried pepper. In order to obtain the constituents in a concentrated form, an oleoresin is produced from ground peppercorns, mixed with solvents such as alcohol, acetone or ether. Separating the solvents produces a pepper oleoresin which contains the different piperidide varieties such as piperine and chavicine, which are isomers with empirical formula $C_{17}H_{19}NO_3$, or piperettine with empirical formula $C_{19}H_{21}O_3N$. These varieties have been described in the specialist literature, in particular by Gildemeister and Hoffmann, in "Die Atherischen Öle" ["Ethereal Oils"], 3rd Edition, Vol. II, 457.

In its preferred form, the composition of the invention uses piperine which is almost insoluble in water, but soluble in alcohol, acetic acid, ether and chloroform. When distilled with soda lime, it produces a volatile alkaloid: piperidine ($C_5H_{11}N$) and piperic acid ($C_{12}H_{10}O_4$).

Piperine is obtained from a number of species of peppers from the Piperaceae family, where they are present in amounts of 3% to 10% by weight. In particular, piperine is to be found in essential black pepper oil cultivated in Madagascar, the Indies, Sri Lanka, the Philippines and in Brazil. The yield of essential oil is 1.6% to 2.9%.

Examples of particularly suitable peppers are:

black or common pepper, the fruit of *Piper Nigrum L.*, a climbing vine from India and Malaysia;

long pepper: *Piper longum L.* and *Piper Officinarum;*

*Betel-Piper Betle L.;*

*Piper methysticum* or intoxicating pepper;

*Piper Parthenium;*

*Piper angustifolium;*

*Xylopia aethiopica*, or malaguetta pepper.

The composition of the invention also contains at least one capsaicinoid, such as capsaicin, for example from a capsicum extract. Capsaicin has the empirical formula $C_{18}H_{27}NO_3$.

Capsaicin is obtained by acetone extraction of dried and ground capsicums from the Solanaceae family, in particular the species *Capsicum Frutescens L.* or garden capsicum, and *Capsicum annuum L.*, or pimento. These varieties are cultivated in all tropical and warm temperate regions, in particular in the Indies and in Japan, where the capsaicin yield is 4% to 8% by weight of the treated capsicum.

Additives to active ingredients:

The composition of the invention can be prepared by mixing the active ingredients described above, based on extracts of pepper and capsicum, with an impregnating solution which acts as a coupling solvent, so that the irritant effect of the piperine, piperidide and capsaicin is reinforced by means of a synergetic effect.

By preventing insolubility, the coupling solvent can produce a homogeneous mixture of the constituents at room temperature, producing the maximum desired incapacitating effect. The coupling solvent is constituted by a substance which has no odor or only a slight odor, constituted for example by an apolar, anhydrous liquid containing an antioxidant, with a controlled rate of evaporation. A glycol ether can be used, for example, or a component with a hydrophilic pole and a lipophilic pole in the same molecule.

Active properties of the composition:

Whatever the form in which it is used, the composition has irritant, lachrymatory or suffocating properties which cause an uncontrolled panic effect which disorients the aggressor(s) who are then incapable of effective, reasoned action. It is effective for about thirty minutes. The effect also occurs in persons who are under the influence of alcohol or drugs, and in animals.

Secondary properties of the composition:

The composition is neither fatal nor carcinogenic in the doses which are normally used. It is a natural product, and thus by definition it is ecological, and it is biodegradable.

Regarding cleaning and decontamination, it should be noted that the active ingredient is biodegradable and does not persist in textiles onto which it is sprayed. If necessary, objects which come into contact with the active ingredient can be decontaminated with 50% by volume ethyl alcohol or isopropyl alcohol, or by using non-ionic or anionic surfactants in aqueous solution.

Use of the composition:

Because of the irritant action of the composition, even in small doses, precautions are recommended for use. The user should protect the skin, mucous membranes, eyes and hair. Further, when using it in powder form, a mask with a dust filter is recommended for protecting the respiratory passages. In the event of contamination, the person should seek the open air, avoid rubbing the contaminated areas, and wash with plenty of clean water followed by soapy water.

The composition is preferably stored in a dry, dark place. Packaging in nitrogen can optimize the storage time.

Presentation of the composition and devices for use:

The composition of the invention enjoys great flexibility of use and its use can be adapted to a great variety of defense situations or military operations.

Thus the composition of the invention can be presented in the form of a solution of active ingredients and, if necessary, a coupling solvent in a range of concentrations, packaged in a packaging and/or projection device for projection towards a human or animal target. To this end, the device comprises means for projecting the solution against a human or animal target, in contact with which the incapacitating composition spreads out and produces its effect. An example of a suitable projecting device is an aerosol containing the solution of the composition and a propellant constituted by a liquefied gas, which may or may not be inflammable, preferably a gas which does not harm the environment, such as 134A or 1,1,1,2-tetrafluoroethane, or a compressed gas such as nitrogen ($N_2$), nitrous oxide ($N_2O$) or carbon dioxide ($CO_2$).

The aerosol is provided with a valve and a high-flowrate diffuser which produces a mist with a range of a few meters.

Alternatively, the composition is simply sprayed using any type of sprayer which is suitable for the desired flowrate and range and which generates a mist of liquid droplets, such as a small spray flask driven by a manual pump for short ranges, or a sprayer lance supplied from a receptacle such as a tank or a reservoir for higher flowrates and ranges.

In a further embodiment of the invention, the solution of the composition is packaged in microspherules, capsules or gelatine capsules, which are projected against the surface of the target, where they burst and spread the composition. The capsules, gelatine capsules or microspherules may be packaged in projection means with a longer range, for example a bullet for a firearm or the like, so that the projectile charge bursts at the point of impact and spreads the charge over the target.

The invention also provides that the composition is in the form of a granulated powder obtained from granulates of the incapacitating composition, or in the form of an inert powder associated with the incapacitating composition.

With an inert powder, the grains of powder are either coated with the composition, or the composition as a solution is adsorbed by the powder, which is therefore impregnated with the composition.

The advantage of using a powder resides in the fact that when projected, the powder particles can cover a large surface or volume in which the target persons or animals are to be found.

The impregnated powder can be projected against the target using a suitable packaging and/or projecting device, constituted, for example, by pyrotechnic and/or smoke-producing projection means.

The support powder used is of inorganic origin with a fine, controlled grain size, for example, which has undergone a specific water-repellent and anti-clog treatment. The powder support can thus be selected from a variety of inert powders, in particular of pharmaceutical or cosmetic quality. As an example of the powder, a mixture of talc (about 20%), colloidal silica (about 20%), and calcium carbonate (about 60%) can be used. 0% to 20% of magnesium carbonate and about 1% to 20% of magnesium stearate can be added to the above constituents, slightly reducing their initial proportions.

Alternatively, the granulated powder or inert impregnated powder is encapsulated in microspheres or capsules which act as a charge for a munition such as a grenade, the explosion of which distributes the charge, and thus the incapacitating composition, over an area or a volume.

In a further embodiment which combines the advantages of a composition in solution and a powdered composition, the incapacitating composition is adsorbed in the powder, and the combination of the powder impregnated with the incapacitating composition is suspended in a diluent constituted by a non-miscible liquid. In this case it is possible to use, as the projection means, either an aerosol or a sprayer or a projectile containing the composition in suspension. In this case, the projection of the liquid is initially relatively precise and directional, then when in contact with the target, the powdery form can cover a large area or volume.

Depending on the embodiment selected, the proportion of the incapacitating composition in the composition or powder is in the range from a few percent to 96% by weight. The proportion by weight of the incapacitating composition with respect to the total weight of the supporting powder or the impregnating solution can, of course, vary depending on the specific application, and can readily be determined by the skilled person. The same goes for the concentration of the composition in the aerosol, a concentration which is in the range 5% to 10% by weight of the active mixture procuring all the desired effects, although higher concentrations can be envisaged.

The skilled person can of course select a device with suitable capacity and characteristics for each type of user, higher capacity and longer range devices, and devices with different containers, for example anti-riot grenades or powder dispersers, for use by the military or by the police.

It is clear from the foregoing that the invention is the perfect answer to the objectives. The incapacitating composition of the invention has considerable effectiveness. It provokes an immediate rubefaciant reaction, and causes retreat and inactivity of the target person or animal. The properties of the composition render it suitable for use in anti-attack products. The composition is particularly suitable for charging into aerosols, large capacity reservoirs or anti-riot grenades, or in powder dispersers. The composition can also be used in weapons for military use, however.

I claim:

1. An incapacitating composition containing at least one active ingredient with an incapacitating effect, said active ingredient containing a synergistic mixture of piperidides and capsaicinoids.

2. The incapacitating composition according to claim 1, wherein the capsaicinoids are constituted by capsaicin.

3. The incapacitating composition according to claim 2, wherein the capsaicin is obtained from a capsicum extract from the Solanaceae family, selected from the group formed by *Capsicum Frutescens L.* and *Capsicum annuum L.*

4. The incapacitating composition according to claim 3, wherein said capsicum extract has a guaranteed capsaicin content of no less than 8 percent, preferably in the range of 8 percent to 10 percent.

5. The incapacitating composition according to claim 1, wherein the piperidides contain piperine and are obtained from an essential pepper oil.

6. The incapacitating composition according to claim 5, wherein the essential pepper oil is obtained from a pepper from the Piperaceae family, in particular a pepper from the group formed by: black or common pepper, the fruit of *Piper Nigrum L.*; long pepper: *Piper longum L.* and *Piper Officinarum; Betel-Piper Betle L.; Piper methysticum; Piper Parthenium; Piper angustifolium*; and *Xylopia aethiopica.*

7. The incapacitating composition according to claim 1, wherein said composition comprises a coupling solvent to produce a homogeneous mixture of the constituents at room temperature.

8. The incapacitating composition according to claim 7, wherein said coupling solvent is constituted by a substance with no odor or only a slight odor, constituted by a hydrophilic pole and a lipophilic pole in the same molecule, such as a glycol ether.

9. The incapacitating composition according to claim 1, wherein said composition is presented in the form of a solution of the active ingredients and, if necessary, a coupling solvent, said solution being adapted to be projected towards a target by means of a packaging and/or projection device.

10. The incapacitating composition according to claim 1, wherein said composition is presented in the form of a powder which is impregnated with the active ingredients, said impregnated powder being adapted to be projected towards a target by means of a packaging and/or projection device.

11. The incapacitating composition according to claim 10, wherein said impregnated powder is diluted in a non-miscible liquid, such that the powder is projected by projecting the liquid.

12. A device for using the incapacitating composition according to claim 1, said composition being in the form of a solution which is diluted to a greater or lesser extent, wherein said device comprises a means for projecting said solution against a human or animal target, to spread the incapacitating composition over the target.

13. The device according to claim 12, wherein said projection means is constituted by an aerosol containing the solution and a propellant.

14. The device according to claim 12, wherein said projection means is constituted by a solution spraying device, in particular, a spraying lance supplied from a receptacle such as a reservoir.

15. The device according to claim 12, wherein said projection means are constituted by a projectile containing capsules or microspherules of solution, said projectile being intended to burst at the point of impact to spread the charge over the target.

16. A device for using the incapacitating composition according to claim 1, said incapacitating composition being associated with a powder, said device comprising means for projecting said powder against a human or animal target, to spread the composition over an area and/or in a volume.

17. The device according to claim 16, wherein the incapacitating composition is adsorbed in said powder, and in that said projection means are constituted by pyrotechnic and/or smoke-producing means for projecting the powder which has been impregnated with the composition.

18. The device according to claims 16, wherein the incapacitating composition is adsorbed in said powder, the combination of the powder impregnated with the incapacitating composition being dispersed in a diluent in which it is in suspension, and in that said means for projecting the impregnated powder are constituted by an aerosol containing a propellant, or by a sprayer.

19. The device according to claim 16, wherein the incapacitating composition is adsorbed in said powder, the impregnated powder being granulated and/or encapsulated in microspheres or capsules, and in that said means for projecting the impregnated powder are constituted by a munition, the bursting of which spreads its contents over an area or in a volume.

20. The device according to claim 12, wherein the proportion of incapacitating composition is in the range from a few percent to 96 percent by weight.

21. The device according to claim 16, wherein the proportion of incapacitating composition is in the range from a few percent to 96 percent by weight.

22. The device according to claim 13, wherein the propellant is a liquefied gas, which may or may not be inflammable, in particular 1,1,1,2-tetrafluoroethane, or a compressed gas such as nitrogen, nitrous oxide or carbon dioxide.

23. The device according to claim 18, wherein the propellant is a liquefied gas, which may or may not be inflammable, in particular 1,1,1,2-tetrafluoroethane, or a compressed gas such as nitrogen, nitrous oxide or carbon dioxide.

24. The device according to claim 16, wherein said support powder is constituted by an inert mixture of talc, colloidal silica, calcium carbonate and magnesium carbonate.

* * * * *